US012601560B2

(12) United States Patent
Teetzel et al.

(10) Patent No.: US 12,601,560 B2
(45) Date of Patent: Apr. 14, 2026

(54) BUFFER TUBE APPARATUS

(71) Applicant: WILCOX INDUSTRIES CORP., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 135 days.

(21) Appl. No.: 18/643,758

(22) Filed: Apr. 23, 2024

(65) Prior Publication Data

US 2024/0377157 A1 Nov. 14, 2024

Related U.S. Application Data

(60) Provisional application No. 63/464,671, filed on May 8, 2023.

(51) Int. Cl.
*F41C 23/06* (2006.01)
*F41C 23/14* (2006.01)

(52) U.S. Cl.
CPC ..... *F41C 23/06* (2013.01); *F41C 23/14* (2013.01)

(58) Field of Classification Search
CPC .... F41A 3/84; F41A 3/86; F41A 21/26; F41A 21/30; F41A 21/38; F41A 25/12; F41A 25/16; F41C 23/06
USPC ..... 42/1.06, 74, 1.01, 71.01, 72, 73; 89/198, 89/199, 177
See application file for complete search history.

(56) References Cited

U.S. PATENT DOCUMENTS

| | | | | |
|---|---|---|---|---|
| 837,601 | A | 12/1906 | Behr | |
| 3,209,482 | A | 10/1965 | Kuzma et al. | |
| 5,410,833 | A | 5/1995 | Paterson | |
| 5,941,005 | A * | 8/1999 | Battaglia | F41A 17/66 42/70.08 |
| 7,428,794 | B2 * | 9/2008 | Oz | F41C 23/04 42/74 |
| 7,753,679 | B1 * | 7/2010 | Schuetz | F41A 33/00 42/49.02 |
| 8,201,354 | B2 | 6/2012 | Bentley | |
| 8,763,296 | B1 * | 7/2014 | Chvala | F41C 23/14 42/73 |

(Continued)

FOREIGN PATENT DOCUMENTS

KR 101997741 B1 7/2019

OTHER PUBLICATIONS

English machine translation of KR 101997741 B1.
Extended European Search Report in Application No. 24173642.0 dated Oct. 8, 2024, 8 pages.

*Primary Examiner* — Michael D David
(74) *Attorney, Agent, or Firm* — McLane Middleton, Professional Association

(57) ABSTRACT

A buffer tube apparatus for a weapon includes an outer tube defining a longitudinal axis, the outer tube having a first end configured to be coupled to the weapon and a second end opposite the first end, the second end configured to be coupled to a stock. A buffer assembly includes a shock absorber and is disposed within the outer tube. The buffer assembly is configured to absorb an impact of recoil generated by the weapon. An adjustment bar is configured to interact with the stock. The adjustment bar is coupled to the buffer assembly and slidable with respect to the outer tube along the longitudinal axis.

16 Claims, 8 Drawing Sheets

(56) References Cited

U.S. PATENT DOCUMENTS

| | | | | |
|---|---|---|---|---|
| 8,955,245 | B2 * | 2/2015 | Chvala | F41C 23/14 42/1.06 |
| 8,991,088 | B1 * | 3/2015 | Young | F41C 23/04 42/75.03 |
| 9,551,549 | B1 * | 1/2017 | Chvala | F41C 7/00 |
| 11,209,229 | B2 * | 12/2021 | Perez | F41A 3/84 |
| 2010/0229444 | A1 * | 9/2010 | Faifer | F41C 23/04 42/1.06 |
| 2010/0242328 | A1 * | 9/2010 | Faifer | F41C 23/06 42/1.06 |
| 2012/0180353 | A1 * | 7/2012 | Holmberg | F41C 23/06 42/1.06 |
| 2014/0208627 | A1 * | 7/2014 | Ballard | F41C 23/00 29/402.03 |
| 2016/0033225 | A1 * | 2/2016 | Selvetti | F41A 21/482 89/14.05 |
| 2017/0023328 | A1 * | 1/2017 | Irvin | F41C 23/04 |
| 2017/0059271 | A1 * | 3/2017 | Bowen | F41C 23/04 |
| 2017/0299295 | A1 * | 10/2017 | Pawlowski | F41A 3/84 |
| 2017/0328672 | A1 * | 11/2017 | Hewes | F41C 23/14 |
| 2019/0003796 | A1 * | 1/2019 | Selvetti | F41C 23/16 |
| 2022/0214123 | A1 * | 7/2022 | Hamilton | F41A 3/66 |

* cited by examiner

BUFFER TUBE APPARATUS

CROSS REFERENCE TO RELATED APPLICATION

This application claims the priority benefit of U.S. provisional application No. 63/464,671 filed May 8, 2023. The aforementioned application is incorporated herein by reference in its entirety.

BACKGROUND

The present disclosure relates generally to firearms and other projectile weapons, more particularly to a buffer tube apparatus to mitigate impact or recoil forces on the shooter. Buffer tubes help to mitigate felt recoil from firing a weapon, thereby allowing the shooter to maintain control of the weapon, quickly fire follow-up rounds if necessary, and otherwise stay on target. FIG. 8 illustrates a commercial off-the-shelf buffer tube system 10 that allows for the installation of a collapsible, lever-operated stock. The buffer tube system 10 includes a generally cylindrical tube portion 12 and an adjustment bar 14. The tube 10 has threads 12 on one end to attach to a receiver of a weapons. The adjustment bar 14 has a series of positioning holes spaced there along for receiving a lever-actuated locking pin on the stock. When the lever is depressed, the locking pin is released and allows the stock to be slid along the buffer tube to achieve a desired length of pull. The adjustment bar 14 is integral with, or otherwise fixed in position with respect to, the tube portion 12. The tube 10 typically contains a mass which is free to move back and forth within the tube 10 and which is usually attached to a spring that is compressed as the mass moves towards the back of the tube 10, thereby absorbing some of the recoil energy generated when a projectile is fired by the weapon.

In firearms based on the AR-15 platform, the gas system and recoil system cooperate to cycle the bolt action as well as reduce felt recoil. The gas system consists of a gas block located at the end of the barrel, a gas tube that runs from the gas block to the upper receiver, and a gas key on the bolt carrier group. When a round is fired, some of the expanding gas from the ignited gunpowder travels through a small port in the gas block and into the gas tube. The gas travels through the gas key and into the bolt carrier group, where it pushes the bolt carrier rearward.

The bolt carrier group acts as a counterweight and cooperates with a large buffer spring and buffer assembly located inside the buffer tube, which is attached to the lower receiver. As the bolt carrier moves rearward due to the gas pressure, it compresses the buffer spring and drives the buffer assembly towards the back of the buffer tube. The buffer assembly contains a weighted buffer that helps absorb the recoil energy and slow down the rearward movement of the bolt carrier.

The gas pressure and the resistance of the buffer system work together to cycle the action of the firearm. After the bolt carrier group travels far enough to the rear, the buffer assembly rebounds and pushes the bolt carrier forward again, stripping a new round from the magazine and chambering it.

It would be desirable to provide a new buffer tube apparatus that resembles the AR-15 style buffer tube in terms of fit, form, function, and feel that can be used with a firearm that typically lacks a buffer tube apparatus and/or lacks a gas or recoil operated mechanism to cycle the bolt, e.g., manually-cycled firearms. Such firearms include single shot and/or breech loaded firearms, and especially grenade launchers, although other firearms are contemplated, such as muzzle loaders, pump action firearms, lever action firearms, break action firearms, revolvers, firearms that use a rotating cylinder or magazine, and so forth. Although the present development will be described herein primarily by way of reference to firearms, the buffer tube apparatus herein can be adapted for non-firearm weapons such as crossbows and other non-firearm projectile weapons.

The present disclosure contemplates a new and improved buffer tube apparatus and method which is designed to go on a grenade launcher or other firearm that lacks a conventional gas/recoil reciprocating system. Typically, grenade launchers and other firearm types lack a buffer tube apparatus due to the lack of a reciprocated system. Nonetheless, some of these firearms can generate significant recoil, particularly grenade launchers, and more particularly grenade launchers when firing medium velocity rounds. Whereas a grenade launcher firing low velocity rounds may not require a shock mitigation system; a grenade launcher firing medium velocity rounds, which has three times the impulse because it is designed to travel 800 meters versus 400 meters with a low velocity round. The buffer tube apparatus in accordance with this disclosure is operable to buffer the impulse from the soldier when firing a round using such firearms and, in embodiments, advantageously allows soldiers to fire certain sounds such as medium velocity grenade launcher rounds that would otherwise not be possible because the impulse would otherwise be too much for a soldier's shoulder to withstand.

In embodiments, the presently disclosed buffer tube apparatus is configured to mitigate recoil from the round being fired from a grenade launcher, shot gun, or other firearm that lacks a gas/recoil system. In preferred embodiments, the buffer tube apparatus of the present disclosure utilizes a form factor that is similar to an AR-15 style buffer tube, which is a form factor soldiers are accustomed to for muscle memory, although other form factors are contemplated.

Other advantages and benefits will be apparent to persons skilled in the art upon reading and understanding the present disclosure.

SUMMARY

In one aspect, a buffer tube apparatus for a weapon comprises an outer tube defining a longitudinal axis, the outer tube having a first end configured to be coupled to the weapon and a second end opposite the first end, the second end configured to be coupled to a stock. A buffer assembly including a shock absorber, the buffer assembly disposed within the outer tube, the buffer assembly configured to absorb an impact of recoil generated by the weapon. An adjustment bar configured to interact with the stock is coupled to the buffer assembly and slidable with respect to the outer tube along the longitudinal axis.

In a more limited aspect, the first end is a male threaded end configured to threadably engage a complementary female threaded opening on the weapon.

In another a more limited aspect, the outer tube includes a longitudinal gap extending along at least a portion of its length, wherein the longitudinal gap divides the outer tube into opposing longitudinal edges, and the adjustment bar is insertable into the longitudinal gap, the adjustment bar comprising opposing parallel grooves along its length configured to slidably receive the opposing longitudinal edges of the outer tube.

In another a more limited aspect, the adjustment bar includes a plurality of longitudinally spaced apart openings configured to engage with a complementary locking member on the stock for selectively securing the stock at a plurality of positions in relation to the adjustment bar.

In another a more limited aspect, the buffer assembly includes a longitudinally extending piston rigidly affixed to the adjustment bar, the piston slidably engaging a cylinder coaxial with the piston, the cylinder disposed within and rigidly secured to the outer tube. A shock absorber is disposed within the cylinder for controlling movement of the piston in relation to the cylinder upon recoil of the weapon.

In another a more limited aspect, the shock absorber is selected from the group consisting of a plurality of stacked wave springs and one or more compression springs.

In another a more limited aspect, the adjustment bar includes a plurality of bosses which are axially spaced apart and extend within an interior of the outer tube. The piston is coupled to a piston rod, wherein the piston rod includes external helical threads engaging complementary tapped openings in the plurality of bosses, the complementary tapped openings aligned with an axis of the piston.

In another a more limited aspect, the buffer tube apparatus further includes an end cap secured to the first end of the outer tube, the end cap comprising a neck received within an interior of the outer tube and a coupler portion having external helical threads thereon. The external helical threads are configured to threadably engage an internally threaded opening on the weapon. The end cap further includes an internally threaded axial bore and a reducer disposed within the axial bore, the reducer having external helical threads which threadably engage the internally threaded axial bore, wherein the reducer includes an internally threaded reduced diameter axial bore. The cylinder has a support arm having an externally threaded end, wherein the externally threaded end threadably engages the internally threaded reduced diameter axial bore.

In another a more limited aspect, the buffer tube apparatus further comprises an end cap secured to the first end of the outer tube. The end cap comprises a neck received within an interior of the outer tube and a coupler portion having external helical threads thereon. The external helical threads are configured to threadably engage an internally threaded opening on the weapon.

In a further aspect, a combination of the buffer tube apparatus and the stock is provided, wherein the stock includes a longitudinally extending opening configured to telescopically receive the buffer tube apparatus.

In another a more limited aspect of the combination, the outer tube includes a longitudinal gap extending along at least a portion of its length, wherein the longitudinal gap divides the outer tube into opposing longitudinal edges. The adjustment bar is insertable into the longitudinal gap and includes opposing parallel grooves along its length configured to slidably receive the opposing longitudinal edges of the outer tube. The adjustment bar includes a plurality of longitudinally spaced apart openings configured to engage with a complementary locking pin on the stock for selectively securing the stock at a desired position in relation to the adjustment bar. A spring member is configured to urge the locking pin into engagement with an aligned one of the longitudinally spaced apart openings to prevent telescoping movement between the stock and the adjustment bar. A lever on the stock is mechanically coupled to the locking pin, the lever pivotable to selectively disengage the locking pin from the aligned one of the longitudinally spaced apart openings to allow telescoping movement between the stock and the adjustment bar.

In another a more limited aspect of the combination, the plurality of longitudinally spaced apart openings are formed in the base of a longitudinally extending slot, wherein an end of the locking pin, when retracted from the plurality of longitudinally spaced apart openings, is configured to remain within the longitudinally extending slot during telescoping movement between the stock and the adjustment bar and to reengage with another one of the plurality of longitudinally spaced apart openings upon release of the lever.

In another a more limited aspect, the combination further comprises the weapon.

In another a more limited aspect, the weapon is a firearm.

In another a more limited aspect, the weapon is a manually cycled firearm.

In another a more limited aspect, the weapon is a grenade launcher.

BRIEF DESCRIPTION OF THE DRAWINGS

The invention may take form in various components and arrangements of components, and in various steps and arrangements of steps. The drawings are only for the purpose of illustrating preferred embodiments and are not to be construed as limiting the invention.

DETAILED DESCRIPTION OF THE PREFERRED EMBODIMENT(S)

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Detailed embodiments of the present development are disclosed herein; however, it is to be understood that the disclosed embodiments are merely exemplary of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention in relation to the provided figures, and are not intended to limit the structure thereof to any particular position or orientation.

Figure 1:
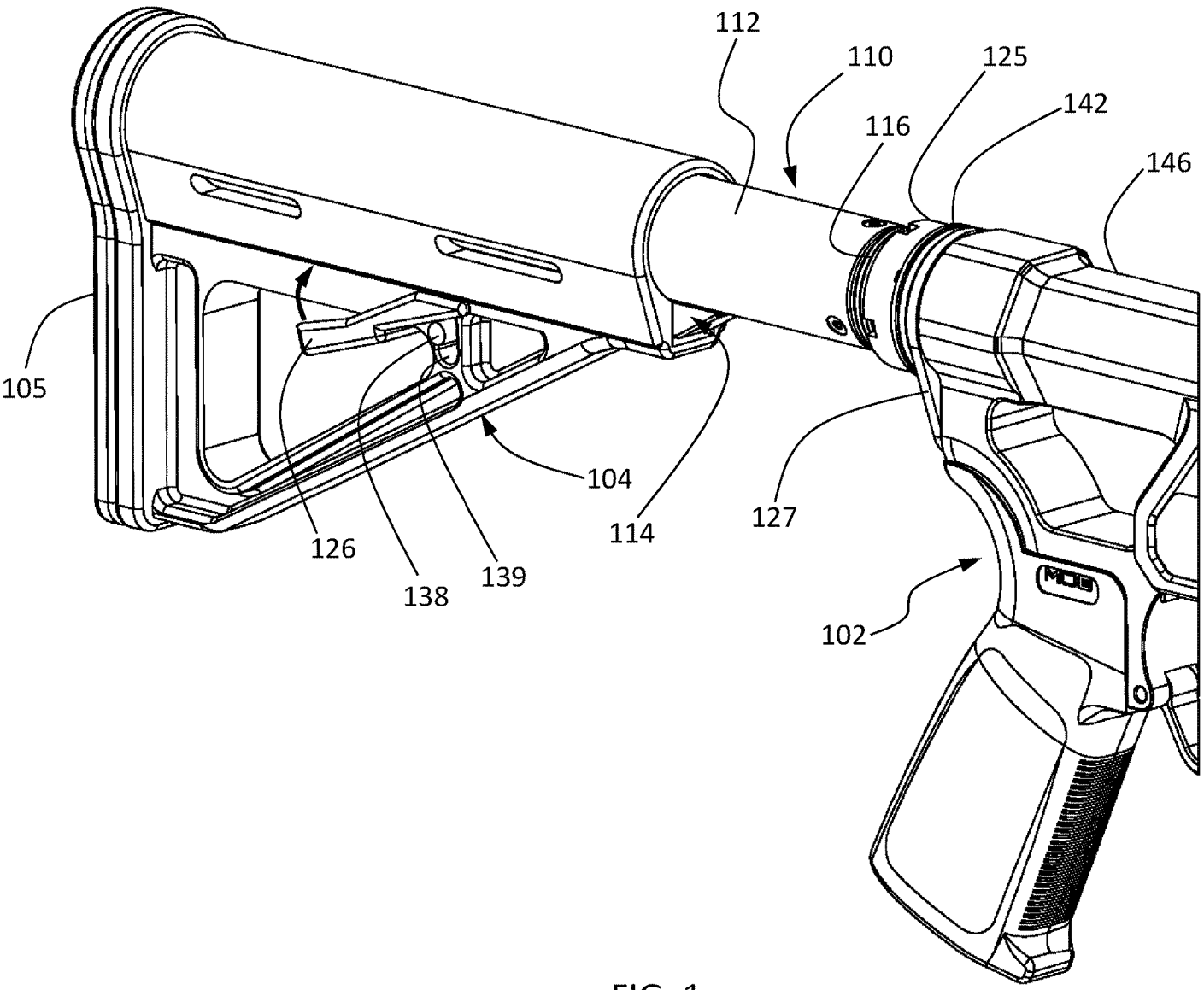
FIG. 1 is a fragmentary isometric view of a firearm employing the buffer tube apparatus in accordance with an exemplary embodiment.

Referring now to FIG. 1 there is shown a firearm 102 having a buffer tube apparatus 110 attached thereto. A stock 104 telescopically receives the buffer tube system 110.

Figure 2:
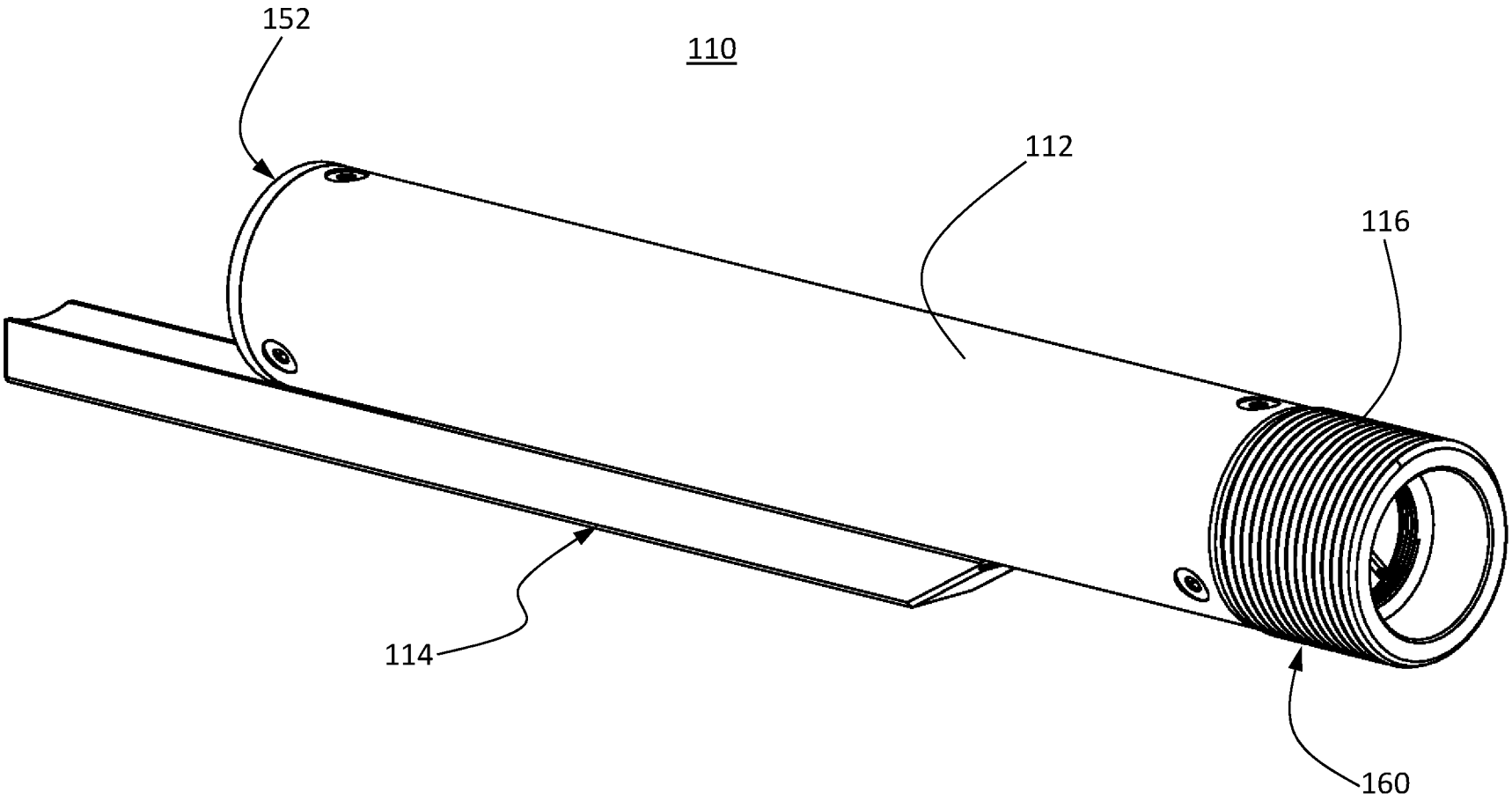
FIG. 2 is an isometric view of the buffer tube apparatus appearing in FIG. 1.
Figure 3:
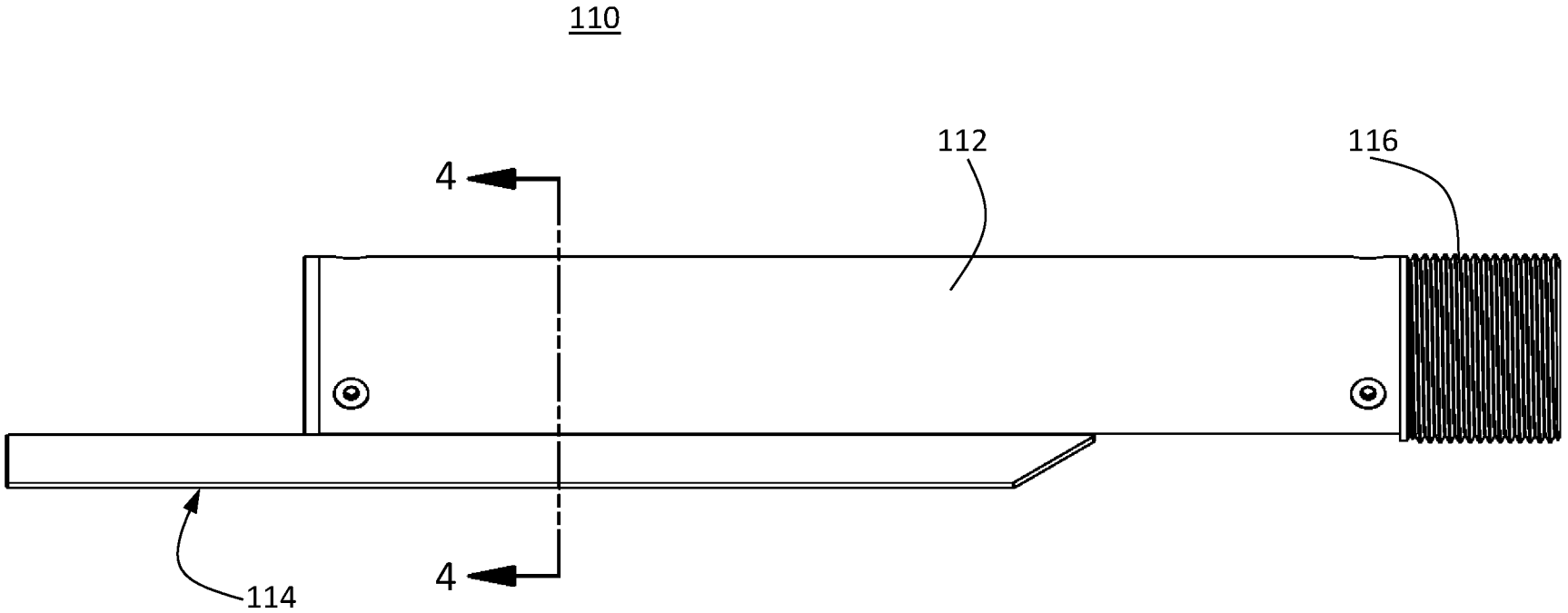
FIG. 3 is a side view of the buffer tube apparatus appearing in FIG. 1.
Figure 4:
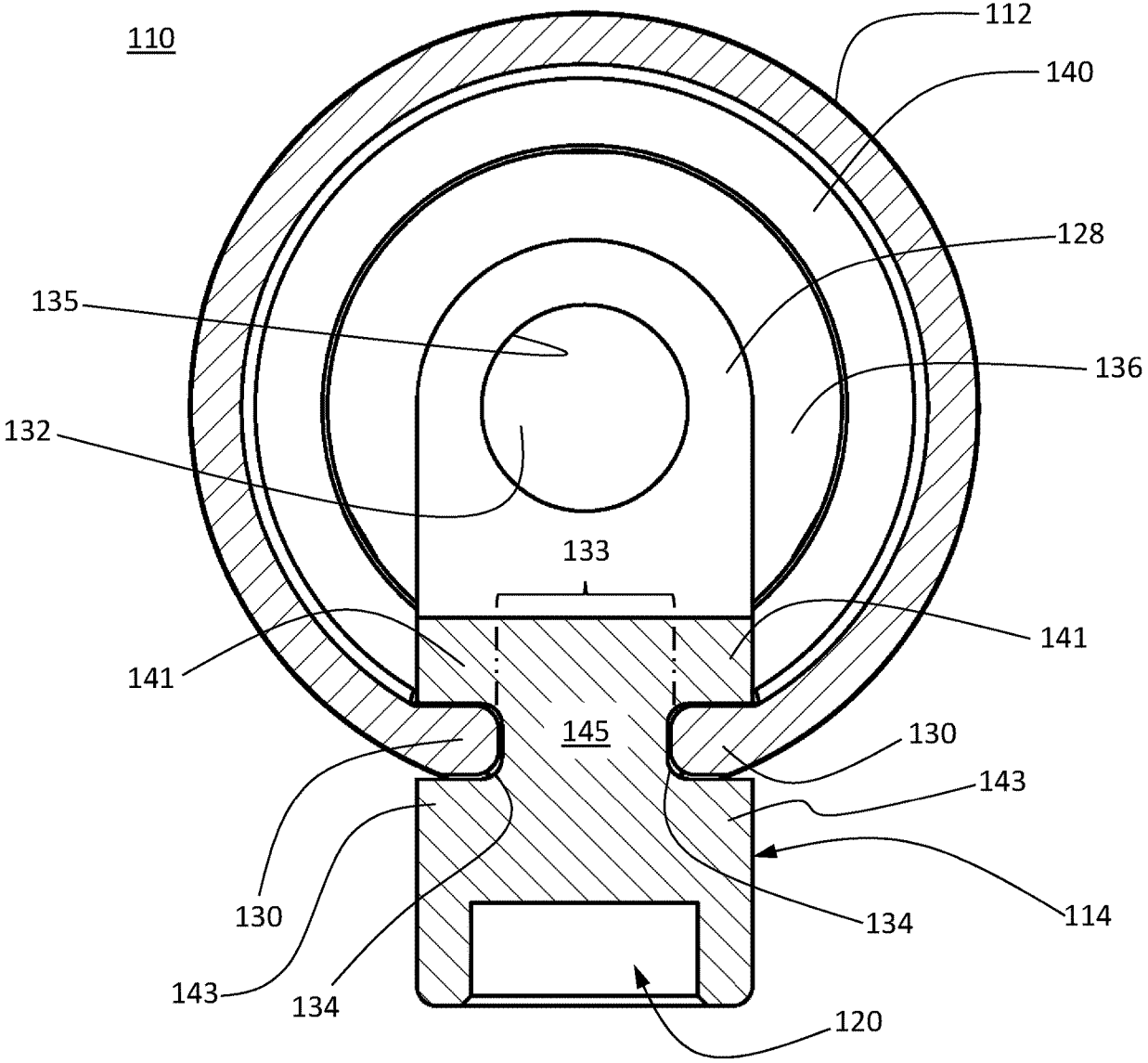
FIG. 4 is a cross-sectional view taken along the lines 4-4 appearing in FIG. 3.
Figure 6:
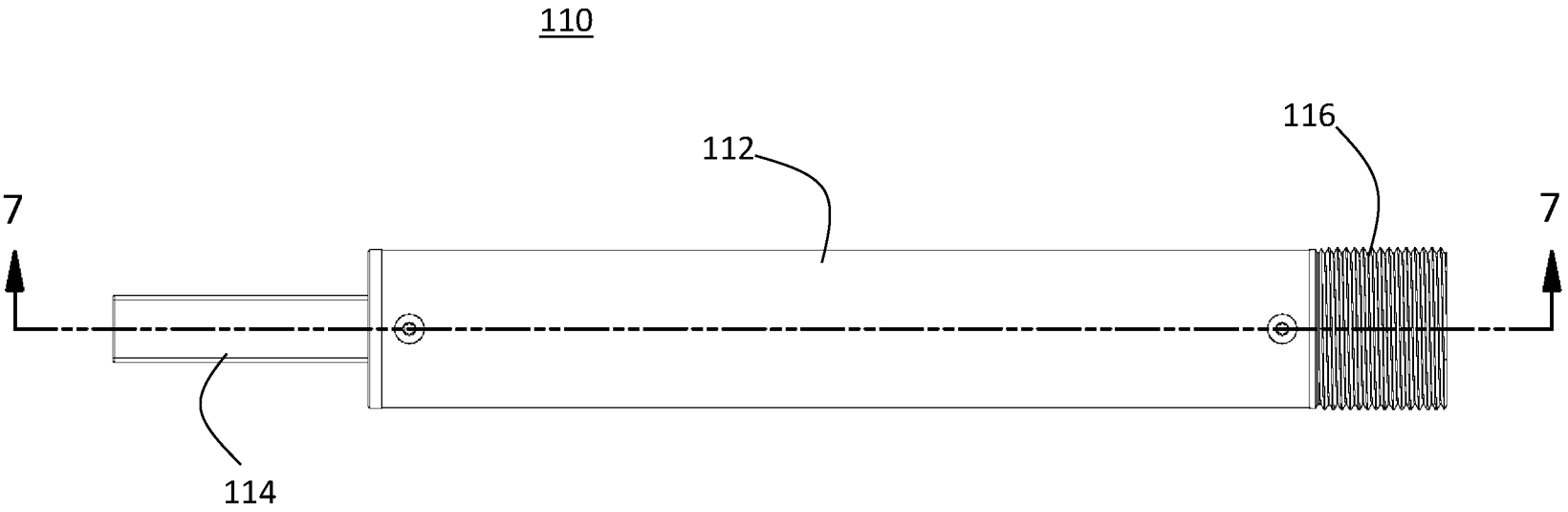
FIG. 6 is a top view of the buffer tube apparatus appearing in FIG. 1.
Figure 7:
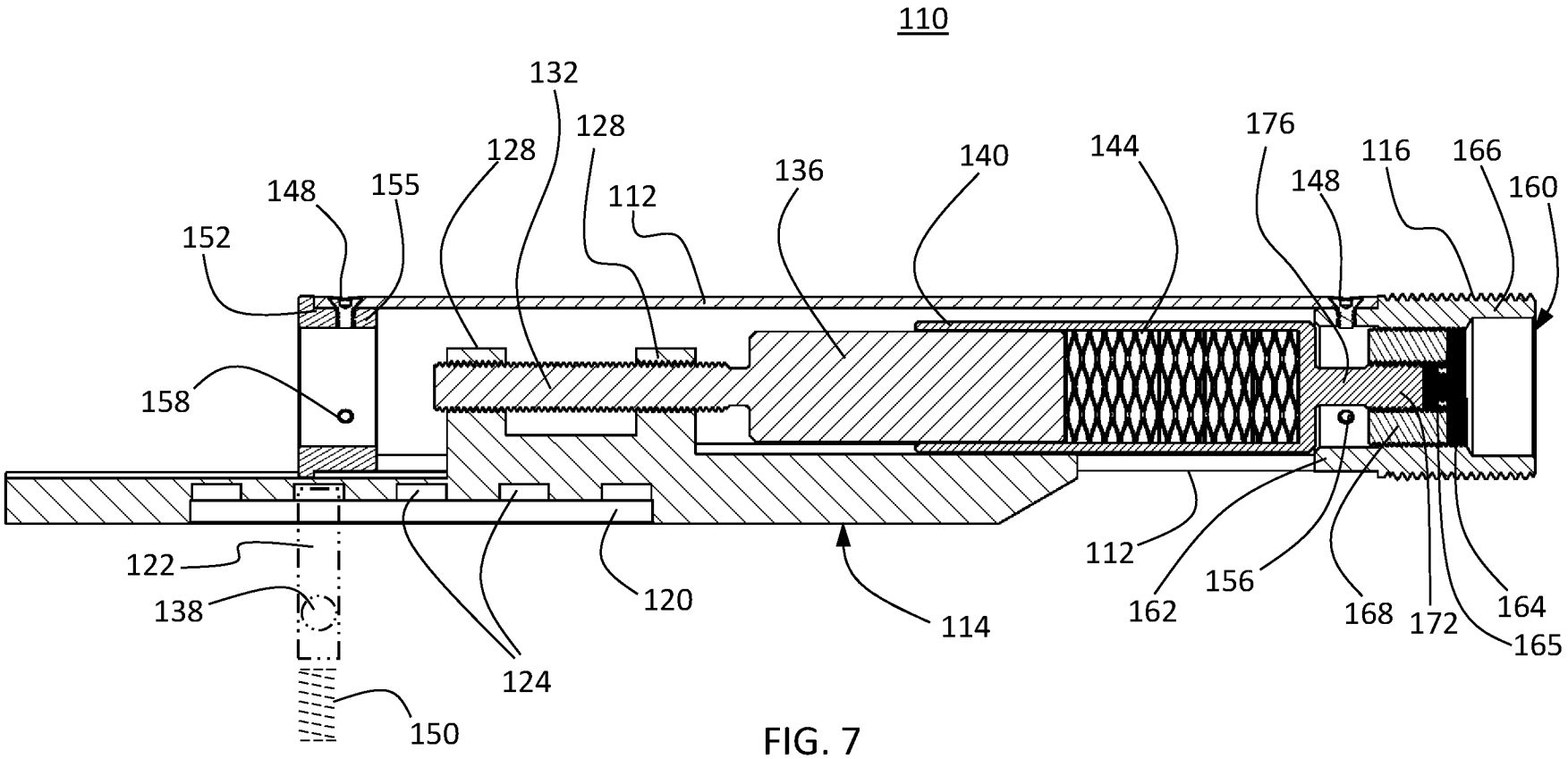
FIG. 7 is a side cross-sectional view taken along the lines 7-7 appearing in FIG. 6.
Figure 8:
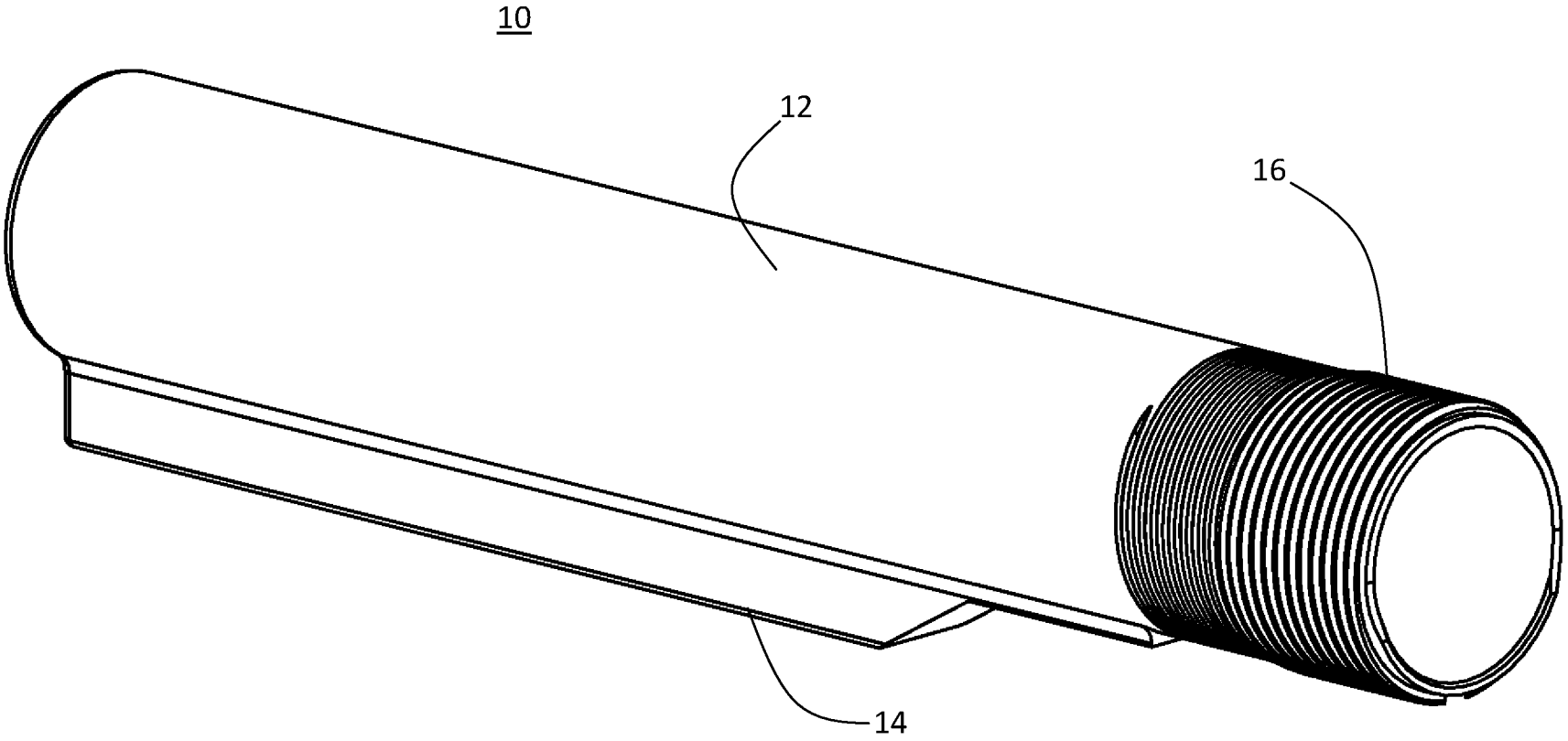
FIG. 8 (PRIOR ART)
FIG. 8 is an isometric view of a prior art buffer tube wherein the tube and adjustment bar are of one piece construction.

Referring now to FIGS. 2, 3, and 6, and with continued reference to FIG. 1, the buffer tube apparatus 110 includes an outer, generally cylindrical housing or tube 112 having an end cap 160 disposed at one end of the tube 112 proximal to the receiver, the end cap 160 having external helical threads 116. A flange cap 152 is secured to the distal end of the tube 112. In embodiments, the flange cap 152 serves to reinforce the distal end of the tube 112. As used herein, the term "tube" refers to a structural element characterized by a hollow interior enclosed by an outer surface. While conventionally associated with cylindrical shapes, it will be understood that the term "tube" as used herein is not limited to a strictly cylindrical geometry. Rather, it encompasses other cross-sectional shapes, including but not limited to rectangular, square, oval, or irregular profiles that exhibit a hollow interior enclosed by an outer surface.

An adjustment bar 114 slidably engages a bottom portion of the tube 112 and is slidable in the axial direction in relation to the tube 112. The firearm 102 includes a receiver 145 which has an internally threaded opening 142. The threaded end 116 of the buffer tube end cap 160 is screwed into the internally threaded opening 142. Once the buffer tube apparatus 110 is screwed into the receiver opening 142, a castle nut 125 threaded onto the buffer tube apparatus 110 is tightened against the receiver 145 to secure the buffer tube 110 in place. In embodiments, an end plate 127 is placed between the castle nut and the rear of the buffer tube, which may be used to attach a sling or other accessory to the firearm.

Referring now to FIGS. 4, 5A, 5B, and 7, and with continued reference to FIGS. 1-3 and 6, the external threads 116 are disposed on the threaded end cap 160. The end cap 160 includes a neck 162 received within the open end of the tube 112 and a coupler portion 166 having the external threads 116. The end cap 160 further includes the bore 165 having internal threads 164. Fasteners 148 pass through clearance openings in the tube proximal end and engage tapped openings 156 in the neck 162. In the illustrated embodiment, three fasteners 148 are spaced 120-degrees apart about the circumference of the tube 112.

A reducer 168 has external threads that engage the internal threads 164 of the threaded cap 160. The reducer 168 also has an internally threaded axial bore 165. A cylinder 140 has an open end receiving a piston 136. A threaded piston rod 132 extends from the piston 136. As used herein, the term "cylinder" refers to a structural component or enclosure that houses and guides a reciprocating or moving element within its interior. While conventionally associated with a cylindrical shape, it should be understood that the term "cylinder" as used herein is not limited to a strictly cylindrical geometry. Rather, it encompasses other geometric configurations, including but not limited to rectangular, square, oval, or irregular shapes that perform a similar function of containing and guiding the reciprocating element. The term "cylinder" is intended to encompass any enclosing structure that facilitates the movement or operation of the reciprocating element within its interior, regardless of its specific shape or form.

A shock absorber 144 is disposed within the cylinder 140 intermediate the piston 136 and the closed end of the cylinder 140. A coaxial cylinder support arm 176 has a threaded end 172 that threadably engages the internal threads of the axial bore 165 of the reducer 168.

The shock absorber 144 is illustrated with a plurality of stacked wave springs, which can be selected to achieve a desired spring stiffness. It will be recognized that other types of shock absorbing systems may also be used, including elastomeric dampeners, hydraulic or air cylinders, bellows, compression springs, counterweights, and others, as well as any combination thereof, to achieve a desired dampening.

The wall of the tube 112 has an axially extending gap or slot 133 which slidably receives the adjustment bar 114. Slot edges 130 of the tube 112 are received within opposing axial grooves 134 on the adjustment bar 114. The axial grooves 134 define upper and lower axial flanges 141 and 143, respectively, and a web 145 extending between the upper and lower axial flanges 141, 143. A pair of axially spaced apart bosses 128 extend upward from the adjustment bar 114 and extend into the bore of the tube 112. The bosses 128 include coaxial openings 135 which are internally threaded and threadably engage the threaded piston rod 132.

The flange cap 152 includes a neck 155 received within the bore of the tube 112 at the distal end thereof. Threaded fasteners 148 pass through clearance openings in the wall of the tube 112 and engage tapped openings 158 in the neck 156. In the illustrated exemplary embodiment, three fasteners 148 spaced 120-degrees apart are used.

A lever 126 is pivotally mounted on the stock 104 and is operatively coupled to a vertical locking pin 122. The locking pin 122 is positioned to engage with a series of spaced apart holes 124 on the underside of the adjustment bar 114, which is slidably secured to the tube 112. In embodiments, the holes 124 are formed within the base of a longitudinally extending slot or channel 120. A horizontal or transverse pin 138 is disposed on the vertical pin 122. When the distal end of the lever 126 is pivoted upwardly, the proximal end which is on the other side of the fulcrum of the lever urges the horizontal pin 138 downward against the urging of a captured spring 150. The horizontal pin 138 rides in an elongate slot 139 on the stock 104. The slot 139 is dimensioned to allow the upper end of the pin 122 to be withdrawn from the openings 124 while remaining within the axially extending channel 120.

To secure the stock 104 at a position to achieve a desired length of pull, i.e., the distance from the trigger to the butt portion 105 of the stock 104, which fits against the shoulder of the shooter, the lever 126 is actuated to disengage the vertical locking pin 122 from the current one of the holes 124 on the adjustment bar 114. In embodiments, when the lever 126 is actuated the vertical locking pin 122 remains within the elongate channel 120 and rides in the channel 120 as the stock 104 is moved back and forth along the buffer tube 100 until the desired length of pull is achieved. The range of sliding movement of the stock is limited by the forward and rearward ends of the channel 120. In the illustrated embodiment, the transverse or horizontal pin 138 protrudes from the side of the stock 104 and is coupled with the vertical pin 122. When the desired length of pull is achieved, the lever 126 is released and the vertical locking pin 122 is urged into the nearest one of the openings 124 by the spring 150 to hold the stock 104 in place at the desired length of pull. In this manner, the length of pull can be adjusted in accordance with the individual shooter's size and preference, while providing the ability to quickly and easily adjust the length of pull to accommodate different shooting positions or firing conditions.

Figure 5A:
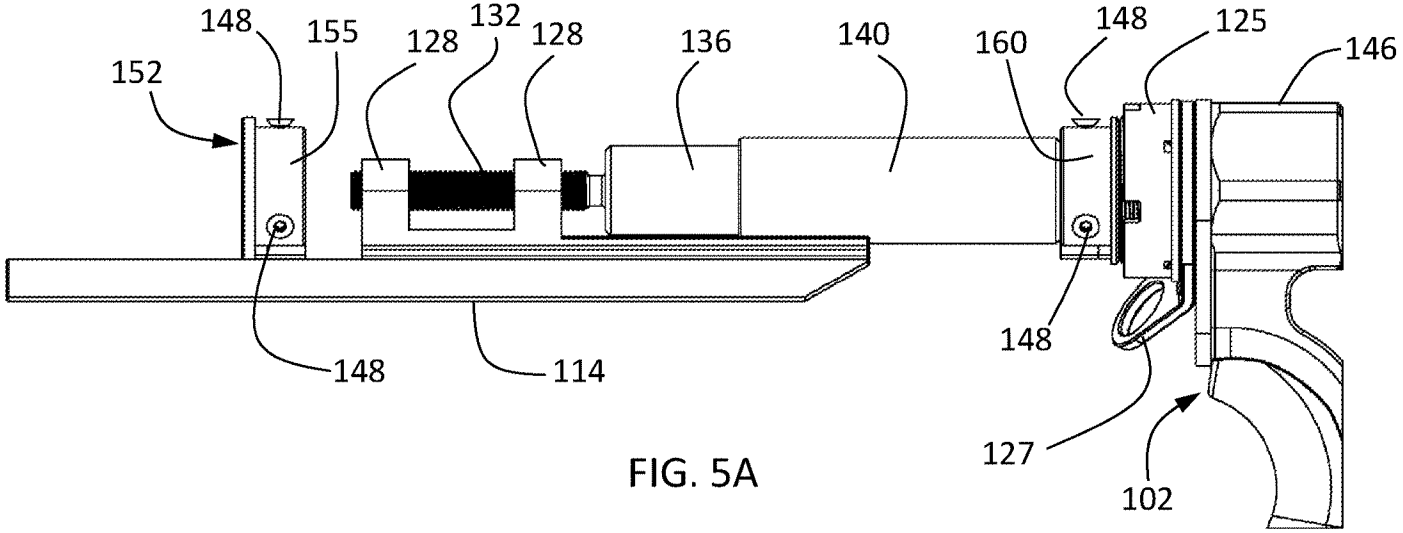
FIG. 5A is a side view of the buffer tube apparatus appearing in FIG. 1 attached to a firearm, with the stock and outer tube removed for ease of exposition, wherein the adjustment bar is in its free state.
Figure 5B:
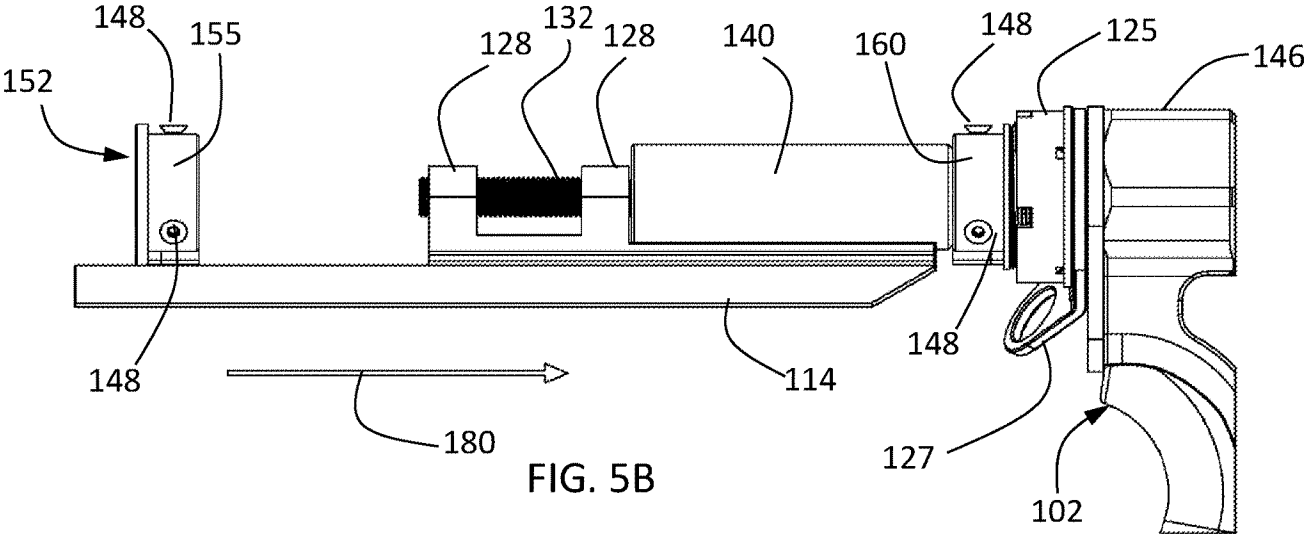
FIG. 5B is a side view of the buffer tube apparatus appearing in FIG. 1 attached to a firearm, with the stock and outer tube removed for ease of exposition, wherein the adjustment bar is in its recoil state.

When the adjustment bar 114 is in its free state, the shock absorber 144 urges the adjustment bar 114 and the piston 136 rearward as depicted in FIG. 5A. When a round is fired, the recoil force that is generated causes the shock absorber 144 to be compressed against the piston 136 which moves into the cylinder 140 as indicated by the arrow 180 in FIG. 5B. As the piston 136 slides forward, it compresses the shock absorber 144 which absorbs energy and reduces felt recoil. The piston 136 is rigidly attached to the adjustment bar 114, which in turn, is rigidly attached to the sliding stock 104. As such, the adjustment bar 114 and stock 104 and adjustment bar 114 move together with the piston 136 in relation to the receiver 145 and the tube 112, thereby further dampening the recoil as compared to a buffer tube system having an adjustment bar that is integral or affixed with respect to the buffer tube. As the shock absorber 144 decompresses, it pushes against the piston 136 to return the piston to its free state and dissipates the absorbed energy. In this manner, felt recoil of the firearm 102 is reduced and overall handling of the firearm is improved.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A buffer tube apparatus for a weapon, comprising:

an outer tube defining a longitudinal axis, the outer tube having a first end configured to be coupled to the weapon and a second end opposite the first end, the second end configured to be coupled to a stock;

a buffer assembly including a shock absorber, the buffer assembly disposed within the outer tube, the buffer assembly configured to absorb an impact of recoil generated by the weapon; and an adjustment bar configured to interact with the stock to adjust a length of pull of the stock, the adjustment bar coupled to the buffer assembly and slidable with respect to the outer tube along the longitudinal axis, wherein the adjustment bar is rigidly coupled to the buffer assembly such that the adjustment bar moves together with the buffer assembly during recoil relative to the outer tube.

2. The buffer tube apparatus of claim 1, wherein the first end is a male threaded end configured to threadably engage a complementary female threaded opening on the weapon.

3. The buffer tube apparatus of claim 1, further comprising:

said outer tube comprising a longitudinal gap extending along at least a portion of its length, wherein the longitudinal gap divides said outer tube into opposing longitudinal edges;

said adjustment bar insertable into said longitudinal gap, said adjustment bar comprising opposing parallel grooves along its length configured to slidably receive said opposing longitudinal edges of said outer tube.

4. The buffer tube apparatus of claim 3, wherein the adjustment bar includes a plurality of longitudinally spaced apart openings configured to engage with a complementary locking member on the stock for selectively securing the stock at a plurality of positions in relation to the adjustment bar.

5. The buffer tube apparatus of claim 3, wherein the buffer assembly comprises:

a longitudinally extending piston rigidly affixed to the adjustment bar, the piston slidably engaging a cylinder coaxial with the piston, the cylinder disposed within and rigidly secured to the outer tube; and a shock absorber disposed within the cylinder for controlling movement of the piston in relation to the cylinder upon recoil of the weapon.

6. The buffer tube apparatus of claim 5, wherein the shock absorber is selected from the group consisting of a plurality of stacked wave springs and one or more compression springs.

7. The buffer tube apparatus of claim 5, further comprising:

said adjustment bar including a plurality of bosses which are axially spaced apart and extending within an interior of the outer tube;

said piston coupled to a piston rod, wherein said piston rod includes external helical threads engaging complementary tapped openings in the plurality of bosses, the complementary tapped openings aligned with an axis of said piston.

8. The buffer tube apparatus of claim 5, further comprising:

an end cap secured to the first end of the outer tube, the end cap comprising a neck received within an interior of the outer tube and a coupler portion having external helical threads thereon, the external helical threads configured to threadably engage an internally threaded opening on the weapon;

the end cap further comprising an internally threaded axial bore;

a reducer disposed within the axial bore, the reducer having external helical threads which threadably engage the internally threaded axial bore, wherein the reducer includes an internally threaded reduced diameter axial bore;

said cylinder having a support arm having an externally threaded end, wherein the externally threaded end threadably engages the internally threaded reduced diameter axial bore.

9. The buffer tube apparatus of claim 1, further comprising:

an end cap secured to the first end of the outer tube, the end cap comprising a neck received within an interior of the outer tube and a coupler portion having external helical threads thereon, the external helical threads configured to threadably engage an internally threaded opening on the weapon.

10. The buffer tube apparatus of claim 1, in combination with the stock, the stock including a longitudinally extending opening configured to telescopically receive the buffer tube apparatus.

11. The combination of claim 10, further comprising:

said outer tube comprising a longitudinal gap extending along at least a portion of its length, wherein the longitudinal gap divides said outer tube into opposing longitudinal edges;

said adjustment bar insertable into said longitudinal gap, said adjustment bar comprising opposing parallel grooves along its length configured to slidably receive said opposing longitudinal edges of said outer tube;

wherein the adjustment bar includes a plurality of longitudinally spaced apart openings configured to engage with a complementary locking pin on the stock for selectively securing the stock at a desired position in relation to the adjustment bar;

a spring member configured to urge the locking pin into engagement with an aligned one of the longitudinally spaced apart openings to prevent telescoping movement between the stock and the adjustment bar; and a lever on the stock mechanically coupled to the locking pin, the lever pivotable to selectively disengage the locking pin from the aligned one of the longitudinally spaced apart openings to allow telescoping movement between the stock and the adjustment bar.

12. The combination of claim 11, wherein the plurality of longitudinally spaced apart openings are formed in the base of a longitudinally extending slot, wherein an end of the locking pin, when retracted from the plurality of longitudinally spaced apart openings, is configured to remain within the longitudinally extending slot during telescoping movement between the stock and the adjustment bar and to reengage with another one of the plurality of longitudinally spaced apart openings upon release of the lever.

13. The combination of claim 10, further comprising the weapon.

14. The combination of claim 13, wherein the weapon is a firearm.

15. The combination of claim 13, wherein the weapon is a manually-cycled firearm.

16. The combination of claim 13, wherein the weapon is a grenade launcher.

* * * * *